United States Patent [19]

Anderson

[11] 4,411,401

[45] Oct. 25, 1983

[54] HEADRAIL MOUNTING BRACKET

[75] Inventor: Richard N. Anderson, Owensboro, Ky.

[73] Assignee: Hunter Douglas, Inc., Totowa, N.J.

[21] Appl. No.: 236,726

[22] Filed: Feb. 23, 1981

[51] Int. Cl.[3] ..... A47H 1/14

[52] U.S. Cl. ..... 248/262; 248/251; 248/254; 248/542

[58] Field of Search ..... 248/251, 254, 262, 264, 248/205 R, 542; 16/94 R, 94 D

[56] References Cited

U.S. PATENT DOCUMENTS

| | | | |
|---|---|---|---|
| 2,651,358 | 9/1953 | Lorentzen. | |
| 2,752,991 | 7/1956 | Charbonneau. | |
| 2,896,902 | 7/1959 | Graber | 248/262 |
| 3,299,943 | 1/1967 | Poe. | |
| 4,079,770 | 3/1978 | Woodle. | |
| 4,177,853 | 12/1979 | Anderson et al. | 160/168 R |
| 4,235,406 | 11/1980 | Vecchiarelli | 248/251 |

FOREIGN PATENT DOCUMENTS

| | | | |
|---|---|---|---|
| 1921979 | 11/1970 | Fed. Rep. of Germany | 248/251 |
| 2425218 | 7/1979 | France | 248/251 |
| 1954544 | 2/1967 | Netherlands. | |
| 1435833 | 5/1976 | United Kingdom | 16/94 R |

*Primary Examiner*—Ramon S. Britts
*Assistant Examiner*—Michael F. Trettel
*Attorney, Agent, or Firm*—Pennie & Edmonds

[57] ABSTRACT

Bracket for supporting the headrail of a venetian blind where the bracket has two oppositely disposed hanger portions adapted to engage shoulder mounts on a headrail. The hanger portions are movable with respect to each other and the bracket has resilient means for urging at least one of the hanger portions into locking engagement with a shoulder support.

18 Claims, 29 Drawing Figures

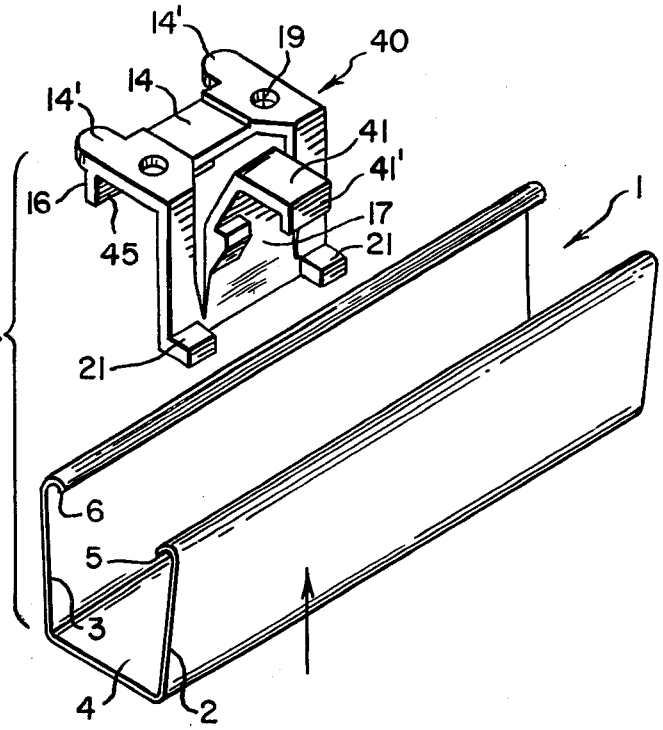
FIG. 4
FIG. 5
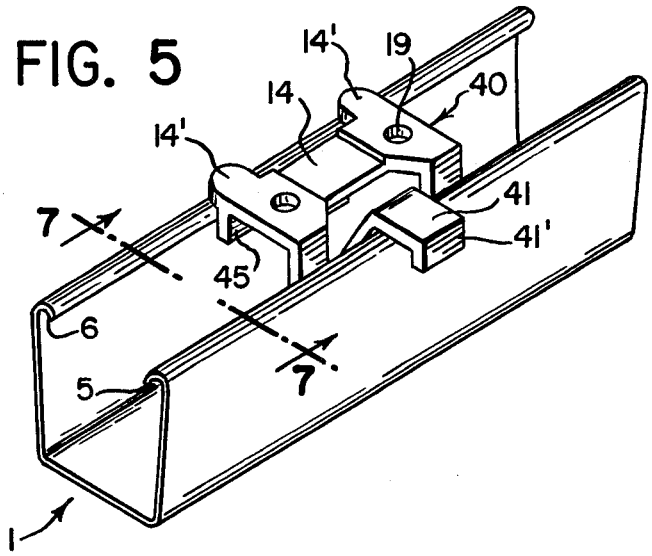

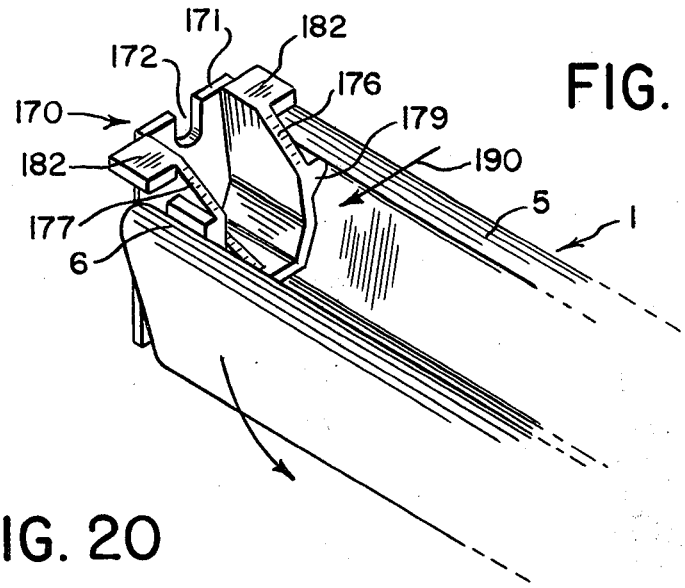
FIG. 19
FIG. 20
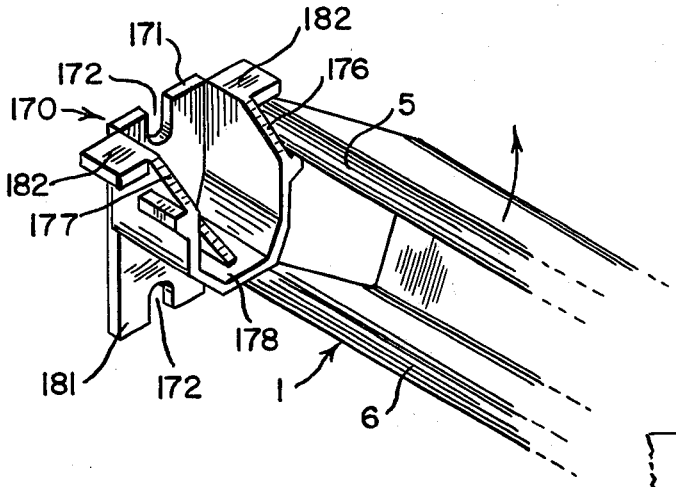
FIG. 23
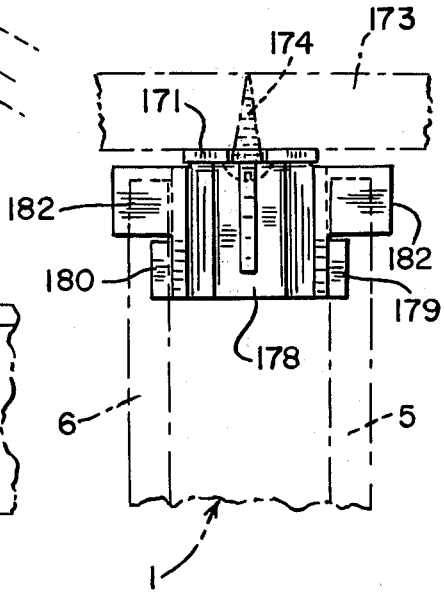
FIG. 22
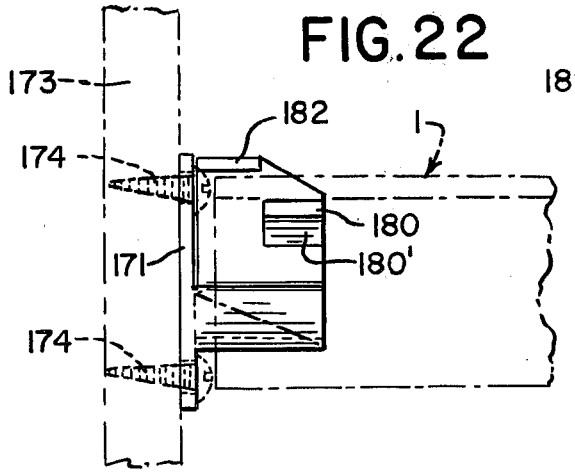

HEADRAIL MOUNTING BRACKET

FIELD OF THE INVENTION

This invention relates to headrail brackets utilized to mount venetian blind headrails to ceilings, walls, window frames and the like.

BACKGROUND OF THE INVENTION

Venetian blind headrails are often mounted to ceiling or wall structure by means of box-like brackets which overlap the ends of the headrail. Such brackets are often made of metal stampings comprising a number of parts and usually require a screwdriver or other special tool in order to disassemble or disengage the headrail from the bracket as may be required for cleaning or repair purposes.

The manner in which the bracket is to be assembled with or disassembled from a headrail or how or where a tool is to be used is often not readily observable, particularly to the layman, leading to difficulty in assembly and disassembly.

Because the bracket overlaps a portion of the headrail, it is readily observable such that in order to maintain a pleasant appearance and color coordination between the headrail and the bracket, it is necessary that the bracket be the same color as the headrail. This requires that a large inventory of brackets be maintained to accommodate the large number of colors utilized in venetian blind installations.

Further the use of box-like brackets as described above which overlap the headrail results in an unsightly gap between the ceiling and the top of the headrail when the headrail is installed.

Further difficulties with brackets as described above is that close manufacturing tolerances must be maintained in both the bracket and headrail structures to assure a tight fit between the parts to prevent objectionable rattling. This necessarily increases cost of manufacture both in the parts produced and in the cost of tool design of tools used in making the parts.

It is therefore an object of my invention to provide for a headrail bracket construction which will overcome the aforementioned difficulties and which is applicable with headrails adapted for use with venetian blinds having horizontally extending slats as well as venetian blinds having vertically extending slats.

GENERAL DESCRIPTION OF THE INVENTION

Broadly a bracket constructed according to my invention comprises first and second hanger portions adapted to engage shoulder mounts on a U-shaped headrail where the bracket includes resilient means for moving the hanger portions relative to each other. The resilient means urges at least one of the hanger portions into locking engagement with a support shoulder.

Where the bracket is adapted for use with a U-shaped headrail supporting horizontally extending slats and where the ends of the vertical legs of the headrail are turned inwardly to form shoulder mounts, the bracket may comprise a center web portion having two flanges depending therefrom. Each flange has thereon an outwardly facing hanger portion.

In one form of the invention, one of the flanges has a lanced portion carrying a hanger portion where the lanced portion forms a spring means to provide the resilient force to move the hanger portion into locking engagement with a shoulder mount. The hanger portions are spaced vertically downwardly on the flanges from the top surface of the center web portion a distance equal to the height of the inturned edges of the headrail such that when the headrail is mounted on the bracket, the bracket will be completely within the headrail with its top surface even with the top of the headrail in order that no gap will be formed between the top of the headrail and a ceiling to which the bracket is fastened.

In a further form of the invention, the bracket may have a small horizontally extending tab positioned on the lanced portion adapted to overlie the inturned end of one leg of a headrail. The tab will then form a small visual indicator of where to apply force to allow disengagement of a headrail from a bracket. Preferably this form of the invention also has an extended part of the center web portion of the bracket extending over the inturned end of the opposite leg of the headrail to provide a small clearance or gap between the ceiling and the top of the headrail in those instances where the appearance of the gap is not objectionable. This small clearance or gap assures that the lanced portion with its horizontally extending tab will have sufficient space to be moved towards the center of the headrail without contacting the ceiling when the headrail is to be removed from the bracket.

Preferably the lanced portions of the brackets include a safety ledge at their lower ends adapted to engage an inturned end of a leg of a headrail when the headrail is being removed from the bracket to prevent its falling.

A further form of the bracket involves having a wall piece of the bracket adapted to be affixed to an end wall at the end of a headrail. In this embodiment of the invention, the wall piece has two spaced flanges thereon each having a hanger portion adapted to engage the inturned ends of the U-shaped headrail. A portion of the wall piece extends below the connectiong portions of the headrail joining the two legs to prevent the bracket from sliding into the headrail. The bottom surface of both hanger portions is sloped or tapered upwardly in order that the ends of the legs of a headrail may be slid over the hanger portions on installation after which the hanger portions snap into place on the shoulder mounts. Horizontal extending indicator tabs may if desired be positioned on the upper end of the flanges so as to extend over the ends of the legs of the headrail to serve as a visual indicator as to where to apply force during removal of a headrail from the bracket.

The invention further contemplates having an adapter by which a bracket may be affixed to a wall behind the headrail. In this instance the adapter comprises a wall piece having a bracket mounting flange at each end thereof adapted to extend perpendicularly over an inturned end of a leg of a headrail. Each bracket mounting flange has a horizontally extending ledge on the bottom thereof adapted to engage and support the bottom surface of a center web portion of a bracket. A tapered locking shoulder is vertically spaced above each ledge to lock a bracket into place on the adapter.

In those instances where the headrail is for use with venetian blinds having vertically extending slats, the headrail takes the shape of an inverted U where the shoulder mounts are on the upper surface of the connecting portions of the U-shape joining the legs. In this instance the bracket according to the invention has a center web portion with a flange depending from one side thereof having the first hanger portion and an inturned edge on the opposite side forming the second hanger portion. The bracket is adapted to overlay the connecting portion of the headrail. In one form of this bracket, the flange is lanced to form a spring means with the free end of the lanced portion forming the first hanger portion. In another form of this bracket, the flange is doubled over to form a spring means with the end portion of the flange forming the first hanger portion.

BRIEF DESCRIPTION OF THE DRAWINGS

FIG. 4 is a perspective view of a further embodiment of a headrail bracket constructed according to the invention prior to the headrail being mounted thereon;

FIG. 5 is a view similar to FIG. 4 illustrating a headrail mounted on the bracket of FIG. 4;

FIG. 19 illustrates the manner in which the headrail is removed from the bracket of FIG. 17;

FIG. 20 is a view similar to FIG. 19 illustrating further removal of a headrail from the bracket of FIG. 17;

FIG. 22 is a side elevational view of the bracket of FIG. 17 mounted to a side wall;

FIG. 23 is a top plan view of FIG. 22;

DESCRIPTION OF THE PREFERRED EMBODIMENTS

Figure 1:
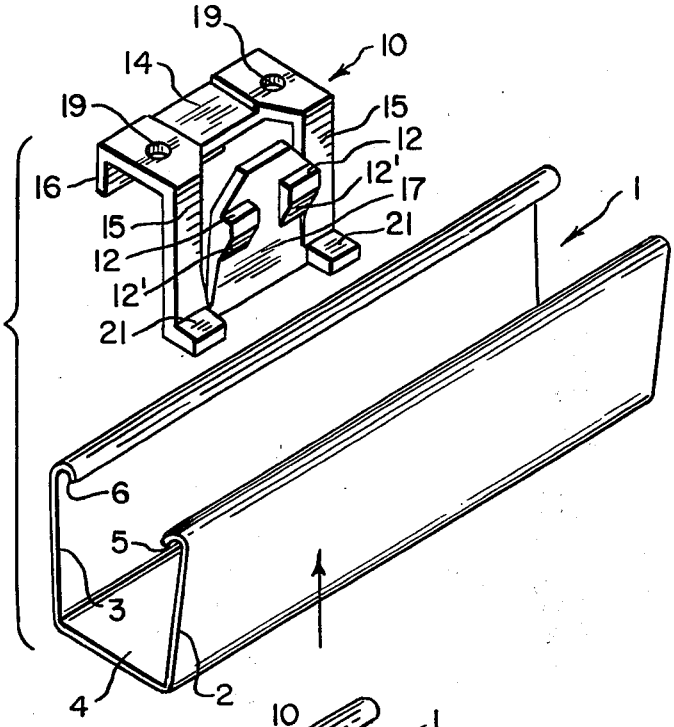
FIG. 1 is a perspective view of a headrail bracket constructed according to the invention and a headrail prior to mounting on the bracket.

Referring to FIG. 1 there is illustrated a U-shaped headrail 1 having vertically extending legs 2 and 3 which are joined by a connecting portion 4. The ends of the vertical extending legs 2 and 3 have inturned edges 5 and 6 which serve as shoulder mounts. The headrail 1 is preferably constructed of metal and is adapted for use with venetian blinds having horizontally extending slats. The headrail illustrated would have a conventionally longitudinally extending tilting mechanism within the headrail by which the slats could be tilted.

Figure 2:
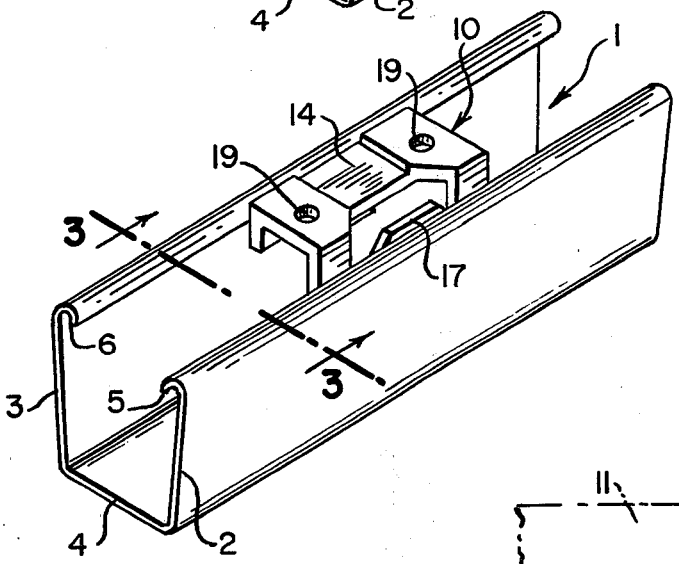
FIG. 2 is a perspective view showing the headrail of FIG. 1 being mounted onto the bracket of FIG. 1.
Figure 3:
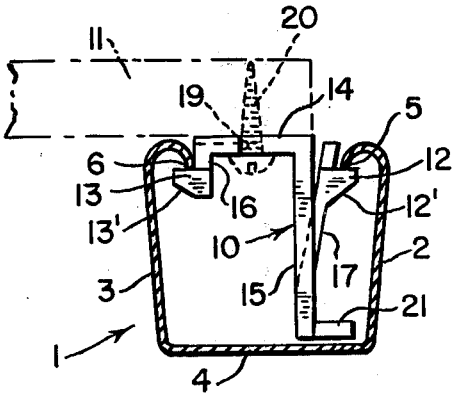
FIG. 3 is a cross-sectional view of FIG. 2 taken along lines 3—3 showing the headrail in a mounted position on the bracket.

A bracket 10 which is adapted to mount the headrail to a ceiling 11 as shown in FIGS. 1–3 comprises a first hanger portion 12 and a second hanger portion 13, which, as explained later, are movable with respect to each other to engage and support shoulder mounts 5 and 6 in order to mount and lock a headrail onto the bracket. As shown in FIG. 1, the bracket 10 has a center web portion 14 from which two spaced flanges 15 and 16 depend. The flange 15 has a lanced portion 17 which forms a spring means which resiliently urges the hanger portion 12 and which is mounted thereon outwardly as shown in FIG. 3 towards the leg 2 of the headrail 1. Mounting holes 19 are included in the center web portion 14 in order to receive screws 20 for affixing the bracket to the ceiling 11. As shown in FIG. 3, the hanger portions 12 and 13 are disposed at a distance from the top of the web portion 14 at a distance equal to the height of the shoulder mounts 5 and 6. The result is that, as shown in FIG. 3, when the headrail is mounted to the bracket, the top of the headrail will be substantially flush with the ceiling 11 so that no unsightly gap will appear between the top of the headrail and the ceiling and the bracket will be substantially completely enclosed by the headrail.

The bottom of the shoulder mounts 12 and 13 are sloped at 12' and 13' in order to provide a camming surface such that upon installation of the headrail to the bracket, the headrail may be pushed vertically upwards as shown in FIG. 1 with the top of inturned portions of the legs engaging these beveled portions. The lanced portion 17 will be forced inwardly allowing the inturned portion of leg 2 to slide over the hanger portion 12 at the same time the inturned portion of leg 3 slides over the hanger portion 13 after which the lanced portion springs outwardly such that the hanger portion 12 resiliently engages the shoulder mount 5 to position and lock the headrail in place on the bracket.

Upon removal of the headrail from the bracket, the headrail is moved to the left as shown in FIG. 3 against the force of the spring means comprising the lanced portion 17 until the opposite shoulder mount 6 disengages from the hanger portion 13. The headrail is then rotated counter-clockwise until the shoulder mount 6 is turned below the hanger portion 13 after which the headrail may be moved to the right allowing the shoulder mount 5 to be disengaged from the hanger portion 12.

Flange 15 as shown in FIGS. 1 and 3 has a safety ledge 21 at the bottom thereof to engage and catch shoulder mount 5 in the event that during removal of the headrail from the bracket, the headrail for one reason or another is inadvertently dropped.

Figure 6:
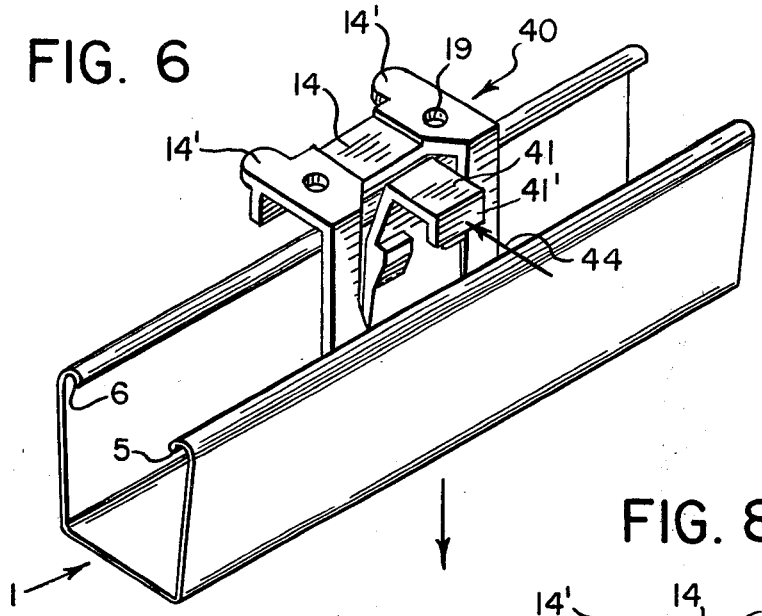
FIG. 6 is a view similar to FIG. 4 illustrating the headrail being removed from the bracket of FIG. 4.
Figure 8:
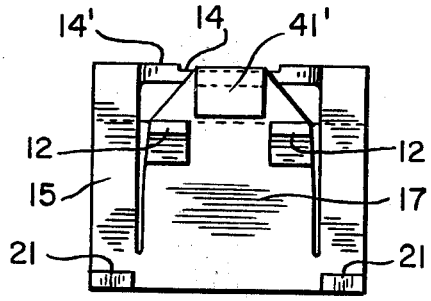
FIG. 8 is a front side elevation of the bracket of FIG. 4.
Figure 7:
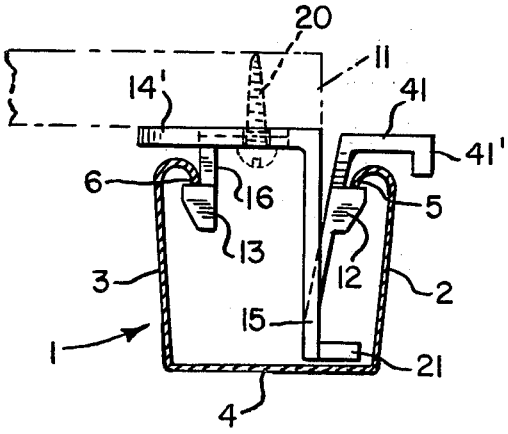
FIG. 7 is a cross-section of FIG. 5 taken along lines 7—7 illustrating the headrail mounted to the bracket.
Figure 9:
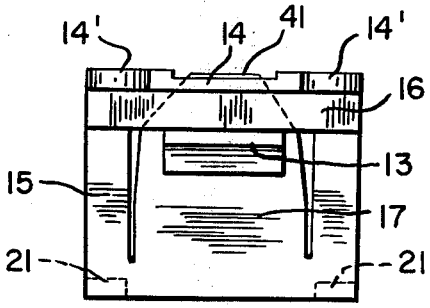
FIG. 9 is a rear side elevation of the bracket of FIG. 4.
Figure 10:
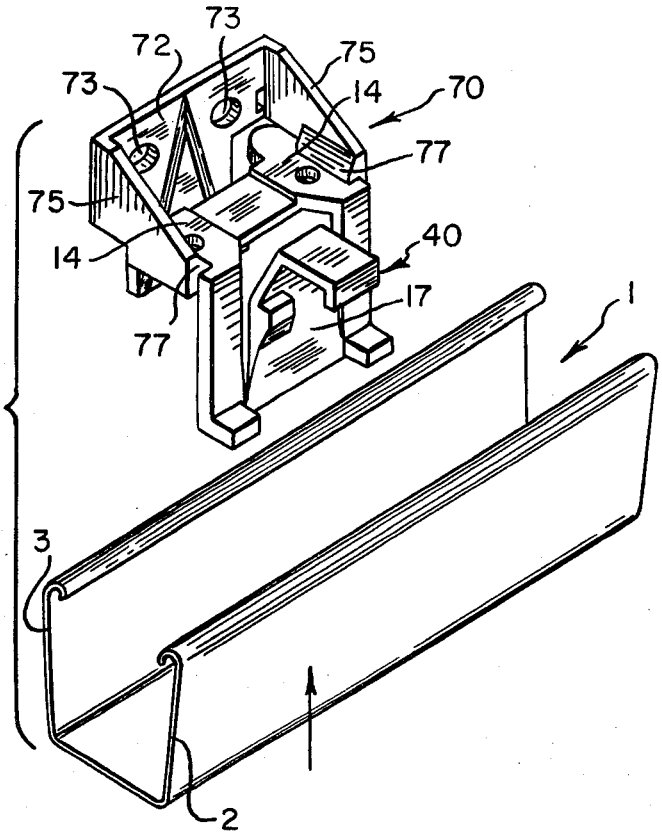
FIG. 10 is a perspective view of the side wall adapter joined with the bracket of FIG. 4 prior to having a headrail mounted thereon.

Referring to FIGS. 4–9, in which like parts have the same identifying numerals as to the parts in FIGS. 1–3, there is illustrated a bracket 40 which is generally similar to bracket 10 except that the bracket is adapted to overlie the turned in ends 5 and 6 of the headrail 1 when mounted to a ceiling as shown in FIG. 7. In addition the lanced portion 17 has a horizontally extending tab 41 with a depending portion 41' adapted to overlap the leg 2 of a headrail as shown in FIG. 5. The center web portion 14 has an extended portion 14' adjacent the flange 16 on which the second hanger portion is mounted and which is adapted to extend over the inturned end of leg 3. As best shown in FIG. 6, the horizontally extending tab 41 and the depending portion 41' provide a visual indicator as to the location of the bracket longitudinally with respect to the headrail and provides an indication as to the manner in which the headrail is to be disconnected from the bracket, that is the tab indicates that a force should be applied to it in the direction of the arrow 44 to allow disengagement of hanger portion 12 from the support mount 5.

The extensions 14' are raised slightly above the top surface of the center web portion 14 to assure that there will be sufficient spacing between the top of the headrail and the ceiling to allow the free end of the lanced portion 17 and tab 41 to be moved inwardly towards the bracket without contacting a ceiling as shown in FIG. 7.

Figure 11:
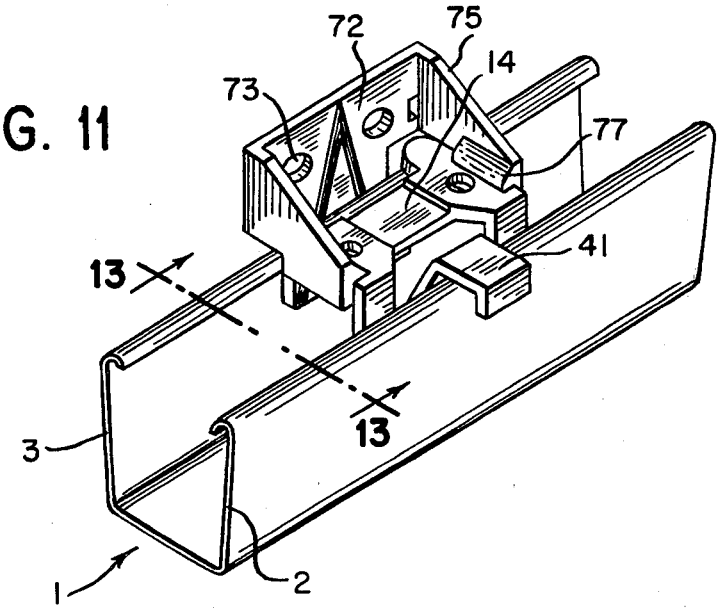
FIG. 11 is a perspective view of a headrail mounted on the bracket and adapter of FIG. 10.
Figure 12:
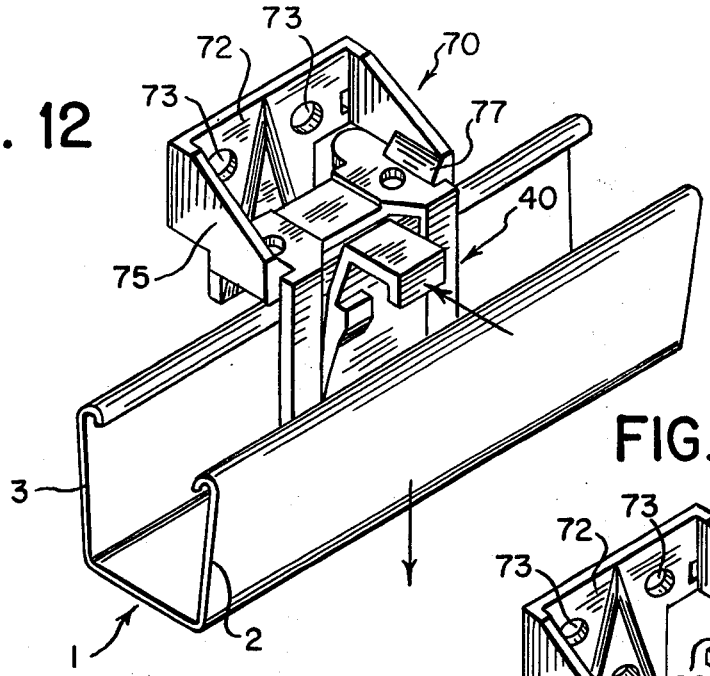
FIG. 12 is a perspective view illustrating the manner in which the headrail is removed from the adapter and bracket of FIG. 11.
Figure 14:
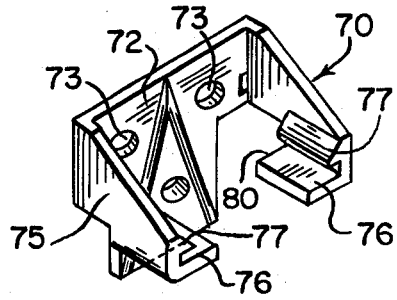
FIG. 14 is a perspective view of the adapter of FIG. 10.
Figure 13:
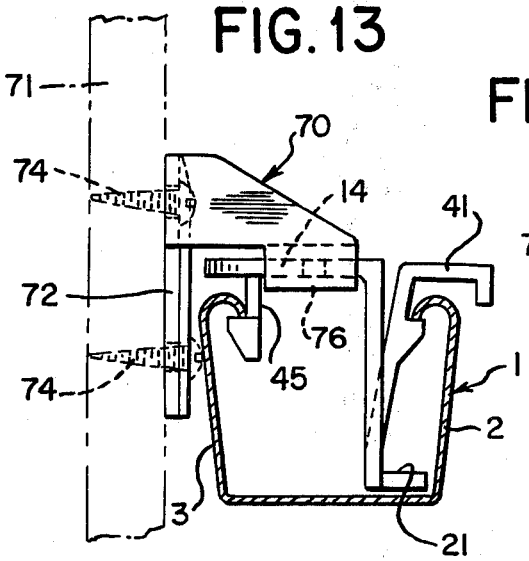
FIG. 13 is a sectional view of FIG. 11 taken along lines 13—13.
Figure 15:
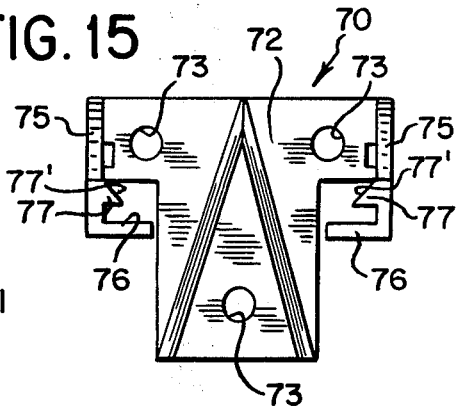
FIG. 15 is a front elevation view of the adapter of FIG. 14.
Figure 16:
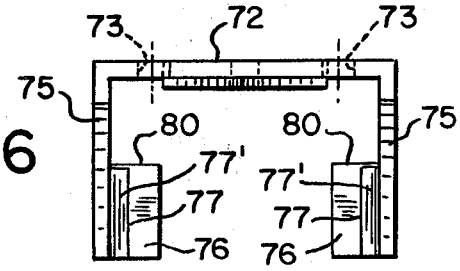
FIG. 16 is a top plan view of the adapter of FIG. 14.

Referring to FIGS. 10–16 there is illustrated an adapter 70 by which the bracket of FIGS. 4–9 may be mounted to a wall 71 extending behind the bracket as shown in FIG. 13. The adapter 70 comprises a wall piece 72 having mounting holes 73 therein through which screws 74 may extend to affix the bracket to the wall. Bracket mounting flanges 75 extend perpendicularly from each end of the wall piece 72 and as shown in FIGS. 11 and 13 are adapted to extend over the inturned end of leg 3 of the headrail 1. A bracket mounting horizontally extending ledge 76 is positioned on the bottom of each flange 74 and is spaced from the wall piece 72. Each ledge is adapted to engage and support the bottom surface of the center web portion 14 of the bracket 40 as shown in FIGS. 10–13. Each bracket mounting flange has a tapered locking shoulder 77 which is vertically spaced over the ledge 76 as shown in FIG. 15. The locking shoulders 77 have upwardly facing tapered surfaces 77' so that the bracket 40 may be assembled onto the adapter 70 by vertically pressing the bracket downward whereby the bottom surface of the center web portion of the bracket will engage the surface 77' to slightly spread the flanges 75 allowing the bracket to be snapped into place within the adapter as the center web portion 14 passes beneath the bottom portion of the shoulder 77.

The bracket 40 preferably has a locking face 45 which forms a part of the flange 16 so as to engage the inside edges 80 of the ledge 76 to prevent the bracket 40 from being moved sideways out of the adapter.

The manner of assembly and disassembly of the headrail with respect to the bracket 40 is the same as that previously described with reference to FIGS. 4–6.

Figure 17:
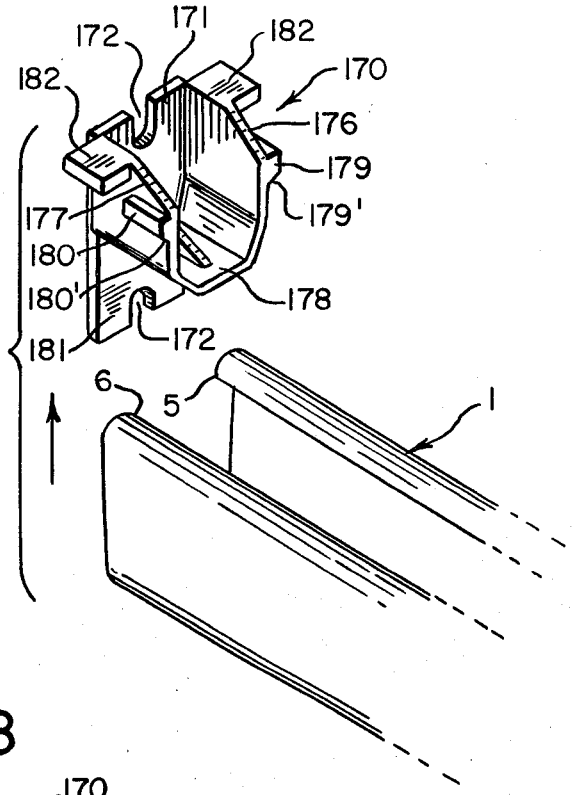
FIG. 17 is a perspective view of a headrail bracket constructed according to the invention for mounting to an end wall prior to mounting of a headrail thereon.
Figure 18:
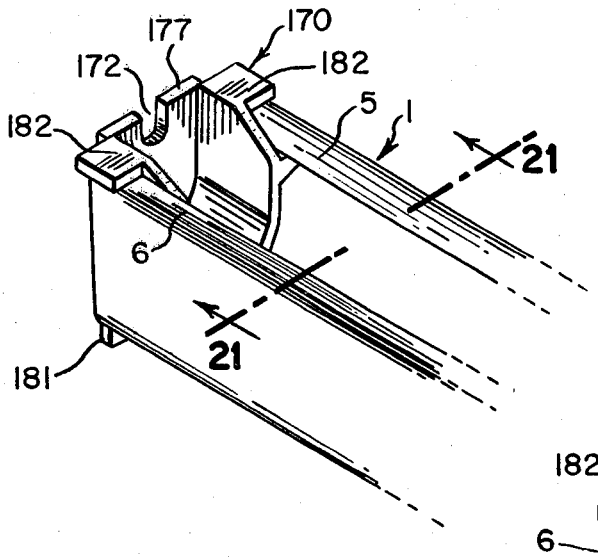
FIG. 18 is a perspective view of the bracket of FIG. 17 on which a headrail is mounted.
Figure 21:
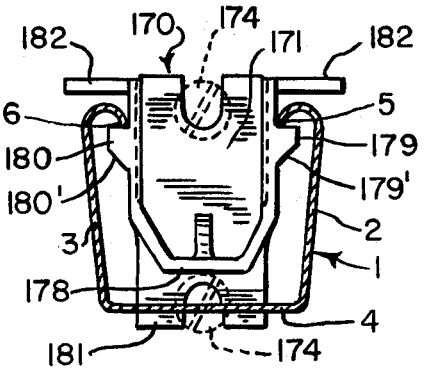
FIG. 21 is a sectional view of FIG. 18 taken along lines 21—21.

Referring to FIGS. 17–23 there is illustrated a bracket constructed according to the invention for mounting a headrail to an end wall. As shown, the bracket 170 comprises a center web portion 171 having mounting recesses 172 therein by which the bracket may be mounted to a wall 173 by screws 174 as shown in FIGS. 22 and 23. The bracket 170 has longitudinally extending flanges 176 and 177 which are connected at one end to a central portion 178 in turn connected to the center web portion 171. Flange 176 has thereon a first hanger means 179 while the flange 177 has a second hanger means 180 thereon where, as shown in FIG. 21, the hanger means are adapted to engage and support the shoulder mounts 5 and 6 of the headrail 1. The center web portion 171 has an extension portion 181 which extends downwardly vertically beyond the connecting portion 4 of the headrail 1 to provide a stop limiting sliding movement of the bracket longitudinally within the headrail. Hanger portions 179 and 180 have tapered faces 179' and 180' in order that the headrail 1 may be mounted to the bracket 170 by moving the headrail vertically upwardly as shown in FIG. 17 such that the top of the inturned edges of the legs 2 and 3 will engage the surfaces 179' and 180' to cause them to flex slightly inwardly towards one another allowing the headrail to be snapped into place on the hanger portions.

Upon removal of the headrail, as shown in FIG. 19, the headrail is moved in the direction of arrow 190 against the bracket allowing the hanger portion 176 to be forced inwardly towards the center of the bracket. This will then allow the shoulder mount 6 to be moved out of engagement with the hanger portion 180 whereby the headrail may be turned as shown in FIG. 20 to complete its disengagement from the bracket.

The bracket 170 may if desired be constructed such that no portion extends above the headrail in order that the headrail may be mounted flush against the ceiling in the same general manner as that described with reference to the brackets of FIGS. 1–3. As shown however in FIGS. 17–23, the bracket 170 includes horizontally extending tabs 182 connected to the flanges which extend over the headrail as shown in FIG. 21. These tabs form a visual indicator to aid in disengagement of a headrail and disengagement may be accomplished by pressing either of the tabs inwardly so as to disengage a hanger portion from a shoulder mount.

It should be noted that the flange 176 and 177 do not join the center web portion 171 directly along their vertical edges as shown in FIG. 17. Rather this area is cut in order to increase the resilient effect of the flanges 176 and 177 to allow them to be moved relatively towards each other during removal of a headrail from the bracket.

The brackets of FIGS. 1–23 as well as the adapter of FIGS. 10–17 are preferably press-molded from a plastic material having resilient properties. As shown, the shapes of the various embodiments of the brackets and of the adapter are readily adaptable to molding techniques utilizing a minimum of material thus substantially reducing costs of manufacture.

Figure 24:
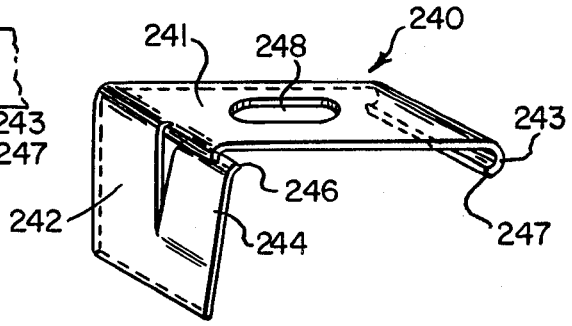
FIG. 24 is a perspective view of a further embodiment of a bracket for mounting a headrail of a venetian blind having vertically extending slats.

Referring to FIGS. 24–27 there are illustrated two forms of a bracket adapted for mounting a headrail to a ceiling where the headrail is of a substantially inverted U-shape of the type supporting venetian blinds having vertically extending slats. The interior of the headrail would include the conventional slat tilting mechanism. As shown in FIG. 24, the bracket 240 comprises a center web portion 241 having a flange 242 depending from one side thereof and where the opposite side thereof has an inturned edge 243. The flange 242 has a lanced portion 244 with the free end of the lanced portion forming a first hanger portion 246 and wherein the inturned end 243 forms a second hanger portion 247. The center web portion 241 has a mounting hole 248 to receive a screw 249 by which the bracket may be mounted to a ceiling 250.

Figure 25:
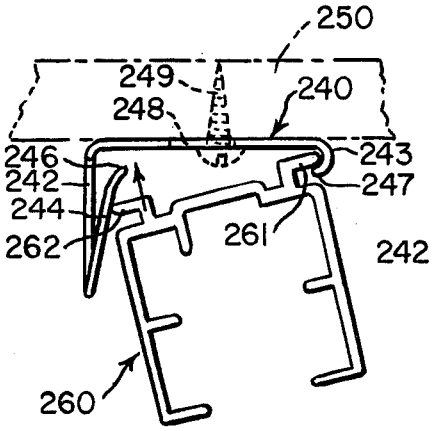
FIG. 25 is an end elevational view illustrating the manner in which a headrail adapted for use with vertical venetian blinds is mounted on the bracket of FIG. 24.
Figure 26:
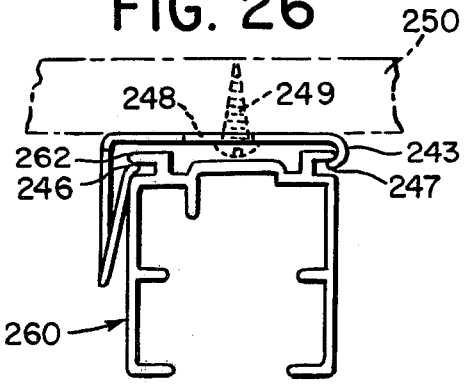
FIG. 26 is an end view of a headrail mounted on the bracket of FIG. 24.
Figure 27:
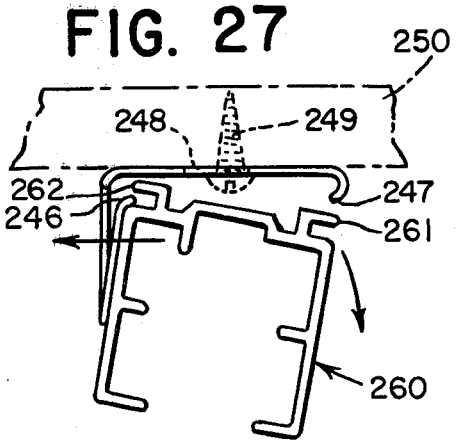
FIG. 27 is an end view illustrating the manner in which the headrail is removed from the bracket of FIG. 24.

The headrail 260 having the inverted U-shape has thereon shoulder mounts 261 and 262. The headrail 260 is mounted on the bracket 240, as shown in FIG. 25, by first engaging the shoulder mount 261 in the hanger portion 247. The headrail is then rotated clockwise as shown in FIG. 25 against the force of the lanced portion 244 until the end of the shoulder mount 262 passes beyond the tip of the lanced portion at which time the tip will snap into place as shown in FIG. 26. The headrail 260 is removed from the bracket as shown in FIG. 27 by moving the headrail to the left against the force of the lanced portion allowing the hanger portion 261 to become disengaged from the shoulder mount 247 after which the hanger may be moved to the right to allow the shoulder mount 262 to become disengaged from the end of the lanced portion.

Figure 28:
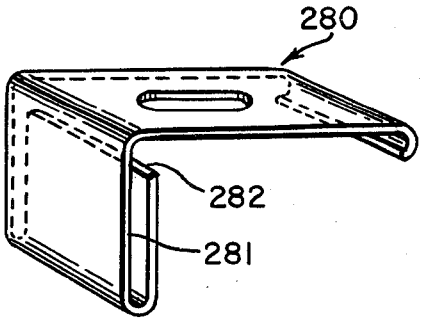
FIG. 28 is a perspective view of a further embodiment of a bracket for mounting a headrail similar to that shown in FIG. 25.
Figure 29:
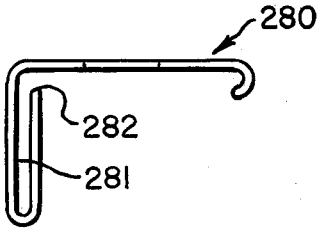
FIG. 29 is an end elevation of the bracket of FIG. 28.

A further embodiment of a bracket generally similar to that of FIG. 24 is illustrated in FIGS. 28 and 29. The main difference is that instead of a lanced portion 244 utilized to form a spring means as shown in FIG. 24, the bracket 280 has a flange 281 which is doubled around itself such that the free end of the flange forms a first hanger portion 282. The manner of installation and removal of a headrail from the bracket 280 is the same as that of a bracket 240 as shown in FIGS. 25–27.

The brackets of FIGS. 25–29 preferably are constructed of a spring-type steel which may be readily stamped into shape.

It is seen that brackets constructed according to my invention comprise a minimum of parts, may be made from a minimum of materials and since most, if not all, of the brackets are substantially hidden within the headrail or in back of the headrail, it is not necessary to maintain a large inventory of brackets of different colors. It is further seen that because all of the brackets utilize resilient portions to lock the headrail with respect to the bracket, that production tolerances in manufacturing the headrail and the brackets need not be excessive and that the headrails will still be held tightly to a bracket without any objectionable looseness. Further use of brackets as described does not require use of tools for installing or removing headrails from the brackets and headrails may be of a conventional design.

I claim:

1. A headrail bracket for mounting a substantially U-shaped venetian blind headrail where said headrail has oppositely disposed shoulder mounts thereon; characterized in that said bracket has first and second oppositely disposed hanger portions which face away from each other and are movable towards and away from each other adapted to engage and support said shoulder mounts, said bracket has resilient means for normally resiliently urging said first hanger portion away from said second hanger portion to resiliently lock a headrail to the bracket wherein said first hanger portion may be moved against the resilient means and toward the second hanger portion to allow disengagement of a hanger portion from a mounting shoulder.

2. A headrail bracket according to claim 1 wherein said bracket has a center web portion and two spaced oppositely disposed flanges depending from said web portion where each flange has an outwardly facing hanger portion thereon adapted to engage inturned ends of the legs of a U-shaped headrail forming shoulder mounts.

3. A headrail bracket according to claim 2 having in addition a spring means associated with said first hanger portion whereby the spring means comprises a lanced portion of a flange and whereby the lanced portion has the first hanger portion positioned thereon.

4. A headrail bracket according to claim 3 wherein said web portion includes mounting holes by which a bracket may be affixed to a ceiling and wherein said hanger portions are disposed on said flanges at a distance from the top of the web portion substantially equal to the height of the inturned ends whereby said bracket may be positioned substantially internally within a U-shaped headrail with the ends of the legs substantially coplanar with a ceiling.

5. A headrail bracket according to claim 3 wherein said lanced portion has a horizontally extending tab spaced vertically above said first hanger portion and adpated to overlie a leg of a headrail when the headrail is mounted on said bracket to provide a visual indicator to indicate the direction of movement of the first hanger portion against its spring means to aid in disengagement of a headrail from the bracket.

6. A headrail bracket according to claim 5 wherein said web has an extended portion adjacent the flange having the second hanger portion adapted to overlie a leg of a headrail when mounted on the bracket whereby said lanced portion may be moved against the spring means without contacting a ceiling to which the bracket may be affixed.

7. A headrail bracket according to claim 3 wherein the bottom of the flange having the first hanger portion has a horizontally outwardly extending safety ledge adapted to engage an inturned end of a leg of a headrail during disengagement of a headrail from a bracket to prevent the headrail falling from the bracket.

8. A headrail bracket according to claim 3 having in addition a wall mount adpater whereby said bracket may be mounted to a wall behind a headrail, said adapter comprising a wall piece having mounting holes therein by which the adapter may be affixed to a wall, a bracket mounting flange at each end of said wall piece extending perpendicularly thereto and adapted to extend over and perpendicular to an inturned end of a leg of a headrail and a bracket mounting a horizontally extending ledge on the bottom of each bracket mounting flange spaced from the wall piece and adapted to engage and support the bottom surface of the center web portion of the bracket.

9. A headrail bracket according to claim 8 wherein said adapter has in addition a tapered locking shoulder spaced above each horizontally extending ledge with the tapered surface of the tapered shoulder facing upwardly and abutting a bracket mounting flange whereby a bracket may be forced vertically downwardly between said flanges such that the center web portion of the bracket may be snapped into place between the horizontally extending ledge and the tapered locking shoulder.

10. A headrail bracket according to claim 8 wherein the flange having the second hanger portion has a locking face adapted to contact an inner edge of said bracket mounting horizontally extending ledges to prevent said bracket from being moved outwardly along said ledges away from said wall piece.

11. A headrail bracket according to claim 2 wherein said center web portion has mounting holes therein by which said bracket may be affixed to an end wall and wherein the center web portion is adapted to overlie the end of a headrail.

12. A headrail bracket according to claim 11 wherein said center web portion has an extension portion extending downwardly beyond said flanges and adapted to abut against the end of a connecting portion of a U-shaped headrail connecting the vertical legs of the headrail.

13. A headrail bracket according to claim 12 wherein said flanges have horizontally extending tabs spaced above the hanger portions and adapted to overlie a leg of a headrail when a headrail is mounted on said bracket to provide a visual indicator to indicate direction of movement of a hanger portion to aid in disengagement of a headrail from the bracket.

14. A headrail bracket according to claim 1 wherein said bracket has a center web portion with a flange depending from one side thereof having thereon said first hanger portion and the opposite side thereof having an inturned edge to form said second hanger portion whereby the web portion may overlie a connecting portion of the U-shaped headrail connecting vertical legs of the headrail.

15. A headrail bracket according to claim 14 having in addition spring means associated with said first hanger portion whereby the spring means comprises a lanced portion of the flange and whereby a free end of the lanced portion forms said first hanger portion.

16. A headrail bracket according to claim 14 having in addition spring means associated with said first hanger portion whereby said spring means comprises a doubled over portion of the flange and whereby a free end of the doubled over portion forms said first hanger portion.

17. A wall mount adapter for mounting a headrail bracket to a wall behind a headrail, said adapter comprising a wall piece having mounting holes therein by which the adapter may be affixed to a wall, a bracket mounting flange at each end of said wall piece extending perpendicularly thereto and adapted to extend over and perpendicular to an inturned end of a leg of a U-shaped headrail, a horizontally extending ledge on the bottom of each bracket mounting flange spaced from the wall piece and adapted to engage and support the bottom surface of a web portion of a bracket, and a tapered locking shoulder spaced above each horizontally extending ledge with the tapered surface of the shoulder facing upwardly and abutting a bracket mounting flange.

18. A headrail bracket for mounting a substantially U-shaped vertical blind headrail where said headrail has oppositely disposed shoulder mounts thereon; characterized in that said bracket has first and second oppositely disposed hanger portions which face towards each other and are movable towards and away from each other adapted to engage and support said shoulder mounts, said bracket has resilient means for normally resiliently urging said first hanger portion towards said second hanger portion to resiliently lock a headrail to the bracket wherein said first hanger portion may be moved against the resilient means and away from the second hanger portion to allow disengagement of a hanger portion from a mounting shoulder.

* * * * *

UNITED STATES PATENT AND TRADEMARK OFFICE

CERTIFICATE OF CORRECTION

PATENT NO. : 4,411,401

DATED : October 25, 1983

INVENTOR(S) : Richard N. Anderson

It is certified that error appears in the above-identified patent and that said Letters Patent is hereby corrected as shown below:

Col. 9, Claim 14, line 1, change "1" to --18--;

Signed and Sealed this

*Nineteenth* Day of *March 1985*

[SEAL]

*Attest:*

DONALD J. QUIGG

*Attesting Officer* *Acting Commissioner of Patents and Trademarks*